United States Patent [19]

Fisichella

[11] 4,323,063

[45] Apr. 6, 1982

[54] MEDICAL FACE MASK

[76] Inventor: Jeanne M. Fisichella, 3716 SW. 30th St., Terrace Apt. 41B, Gainesville, Fla. 32608

[21] Appl. No.: 142,034

[22] Filed: Apr. 21, 1980

[51] Int. Cl.[3] ..... A61B 19/00

[52] U.S. Cl. ..... 128/139; 128/206.12

[58] Field of Search ..... 128/139, 206.12, 206.19

[56] References Cited

U.S. PATENT DOCUMENTS

| | | | |
|---|---|---|---|
| 1,925,764 | 9/1933 | Le Duc | 128/206.12 |
| 3,288,138 | 11/1966 | Sachs | 128/139 |
| 3,438,370 | 4/1969 | Krantz, Jr. | 128/206.12 |
| 3,500,825 | 3/1970 | Andersson et al. | 128/139 |
| 3,664,335 | 5/1972 | Boucher et al. | 128/139 |
| 3,736,928 | 6/1973 | Andersson et al. | 128/139 |

FOREIGN PATENT DOCUMENTS

| | | | |
|---|---|---|---|
| 893614 | 4/1962 | United Kingdom | 128/206.19 |

*Primary Examiner*—John D. Yasko

*Attorney, Agent, or Firm*—Arthur G. Yeager

[57] ABSTRACT

A medical face mask having the central portion of the mask made of a transparent material, providing a view of the wearer's mouth.

3 Claims, 6 Drawing Figures

MEDICAL FACE MASK

BACKGROUND OF THE INVENTION

Face masks are universally used in the medical profession to permit face-to-face communication between the medical person and the patient without risk of transferring infectious bacteria, virus, or the like. In modern practice these face masks are fibrous sheet materials which are flat or are formed into a cup-shape, and which fit reasonably snugly around the wearer's nose, mouth and chin, held in place by one or more head straps, which may be tied to each other or may be elastic. These masks are normally used once and thrown away. The expected life of such a mask is about one hour, due to the fact that moisture from the breath of the wearer makes the mask wet and uncomfortable, and eventually the bacteria filtering capability is substantially decreased.

Furthermore, in covering the mouth a certain amount of communication is lost. Despite the fact that the mask is permeable to air it does destroy some of the clarity of the wearer's speech and makes it more difficult to understand the person wearing the mask. This is, of course, accentuated if the one wearing the mask does not normally speak distinctly and if the other person has any impairment of hearing. Still another disadvantage of the opaque mask is that when the mouth of the speaker cannot be seen it is much easier to be misunderstood. The prior art opaque mask also hides a reassuring smile and lip movements which would assist in understanding the mask wearer.

It is an object of this invention to provide a medical face mask having a longer useful life than prior art masks. It is another object of this invention to provide a medical face mask having a transparent portion over the mouth of the wearer. Other objects will appear from the more detailed description of this invention set forth below.

BRIEF SUMMARY OF THE INVENTION

This invention provides a medical face mask comprising one or more head straps and a mask adapted to fit over the nose, mouth and chin of the wearer and to comform at its edges reasonably closely to the face and neck of the wearer, the central portion of said mask adjacent the nose and mouth of the wearer being made of transparent material, and the remaining annular portion of said mask being made of air-premeable, bacteria-filtering material. In a specific embodiment the transparent material is an impermeable synthetic plastic film and the air-impermeable material is a fibrous sheet.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention can best be appreciated by reference to the accompanying drawings.

Figure 1:
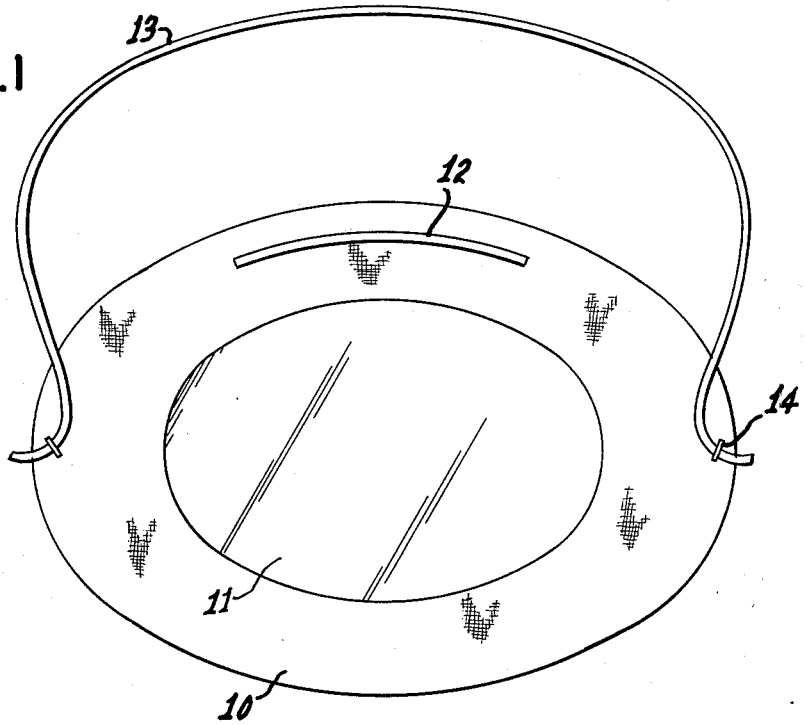
FIG. 1 is a front view of an improved mask in accord with one embodiment of this invention.
Figure 2:
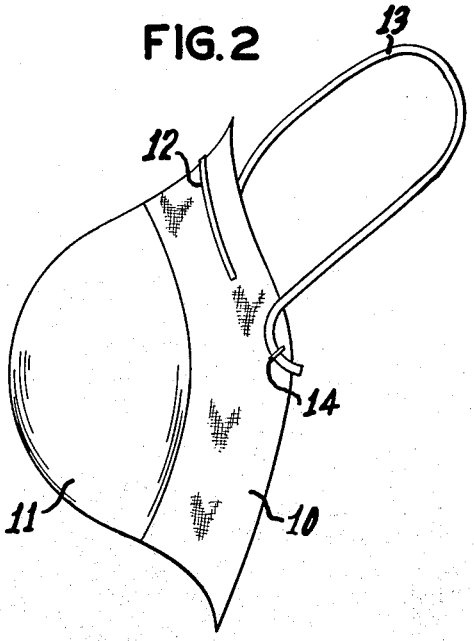
FIG. 2 is a side view of the mask of FIG. 1.
Figure 3:
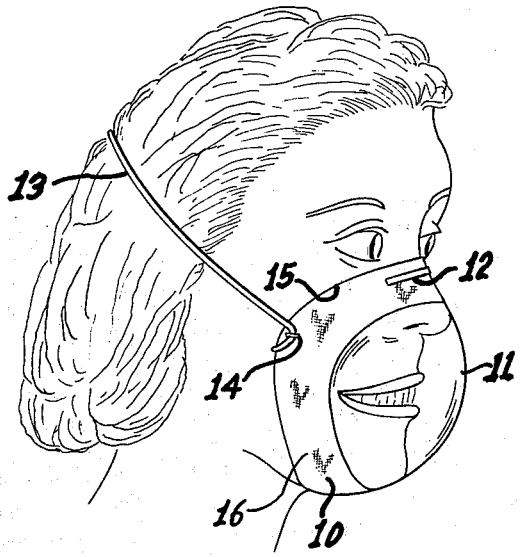
FIG. 3 is a schematic illustration of the mask of FIG. 1 in place over the face of the wearer.

In FIGS. 1 and 2 it may be seen that in this embodiment of the invention the mask is a cup-shaped sheet material comprising a central portion 11 and outer annular portion 10 surrounding central portion 11. Attached to the two sides of the mask by staples 14 is an elastic head strap 13 used to hold the mask in place. Straps that tie rather than elastic straps are equally suitable for this purpose. At the top of the mask is a nose clip 12 in the form of a thin strip of manually bendable material such as a soft metallic alloy of lead or zinc. This nose clip 12 bends readily upon finger manipulation and retains the bend with reasonable stability. Nose clip 12 is affixed by stitching, cementing, or the like to the upper portion of the mask and may be pinched around the bridge of the nose to assure that edge 15 of the mask fits reasonably tightly against the face so as to form an effective seal against the passage of bacteria or virus.

Outer portion 10 is made of a fibrous materal similar in appearance and feel to a gauze bandage or a soft paper. This portion of the mask is permeable to air so that the wearer can breathe easily, but it is impermeable to bacteria, virus, etc. so as to prevent the spread of infection between the wearer of the mask and any other person with whom he is in close contact. Among the fibrous materials which can be used for outer portion 10 are cellulosic fiber, glass fiber, mineral fibers, nylon fiber, acrylonitrile fiber, wool or other natural organic fibers, polyester fiber, and the like. Preferably the fibers are formed into a sheet by a random felting procedure rather than being woven although both types are operable in this invention. Since these masks are normally expected to be disposable, the inexpensive fibers are preferred, e.g. cellulosic, glass, and mixtures thereof. In one embodiment it is desirable to employ a certain amount of material in the mask which will permit molding the mask into a cup shape so it will project outwardly somewhat from the nose and mouth. This stiffening or moldable characteristic can be provided by incorporating moldable fibers into the felted material or by use of a small amount of a suitable coating on the fibers or an adhesive applied to the felted material.

Central portion 11 of the mask is made of a transparent material which preferably is air-impermeable. This is the portion of prior art face masks which deteriorated rapidly because of absorbing all of the moisture from the breath of the wearer. By making central portion 11 air-impermeable the breath directed onto this portion is diverted sidewise in all directions and permeates through the air-permeable section 16 of outer portion 10 of the mask. Outer portion 10 has a greater area than central portion 11 and this provides a greater distribution of the moisture in the breath and, thereby longer useful life for the mask.

A preferred embodiment of the mask of this invention is provided when central portion 11 is both air-impermeable and transparent. By making central portion 11 transparent the mouth and adjacent portions of the face can be seen when the mask is worn. This permits facial expressions and lip movements to be seen which is of great assistance in understanding what is being said by the wearer of the mask. Furthermore, in the treatment of patients who are under some stress and anxiety it is believed that seeing a smile through the mask is an important factor in relieving that stress and anxiety. It is, of course, well known that being able to see the lip movements of a person speaking materially increases the chance of understanding what is being said. Thus, the preferred embodiment of this invention provides a mask with a longer useful life and greatly enhances the ability of the wearer of the mask to communicate his thoughts and feelings to another.

The materials from which central portion 11 is constructed are preferably films of synthetic plastic materials such as ionomer resins, polyolefins, polyesters, polyamides, vinyl polymers, cellulose esters, and polycarbonates. These materials are available as transparent films. A particularly desirable material for central portion 11 is "Surlyn" having a thickness of 0.005 inch. This material is made and sold by E. I. duPont deNemours & Co. of Wilmington, Delaware. If it is not desired to employ a transparent central portion 11, other means can be used to make central portion 11 air-impermeable. For example, the entire mask can be prepared of air-impermeable. For example, the entire mask can be prepared of air-permeable felted fibrous sheet material and central portion 11 can be coated with lacquer, varnish, cement, or the like.

When the mask is made of a combination of felted fibrous sheet material in outer portion 10 and synthetic plastic film in central portion 11, the two portions may be joined to each other by stitching, cementing, the application of adhesive tape to overlapping edges, or any other means which provides a tight seal.

Most of the synthetic plastic films are capable of being heat-molded into a cup-shape, by heating flat film to the softening temperature of the film, shaping the plastic into the desired cup-shape and then cooling the shaped film to room temperature while maintaining the film under the shaping force.

Head strap 13 is any suitable strap or plurality of straps that will hold the mask tightly against the face of the wearer. A single elastic strap is normally sufficient, although two or more may be used. Alternatively, the head strap may comprise one or more pairs of tapes fastened to the mask at only one end such that each pair may be tied together to produce one restraining head strap 13. Of course, more than one pair of such tie tapes may be employed.

Head strap 13 is shown in these drawings as being attached to the mask outer portion 10 by means of metal staples 14. Any other suitable means of attachment is acceptable, e.g. stitching, cementing, riveting, or the like.

Figure 4:
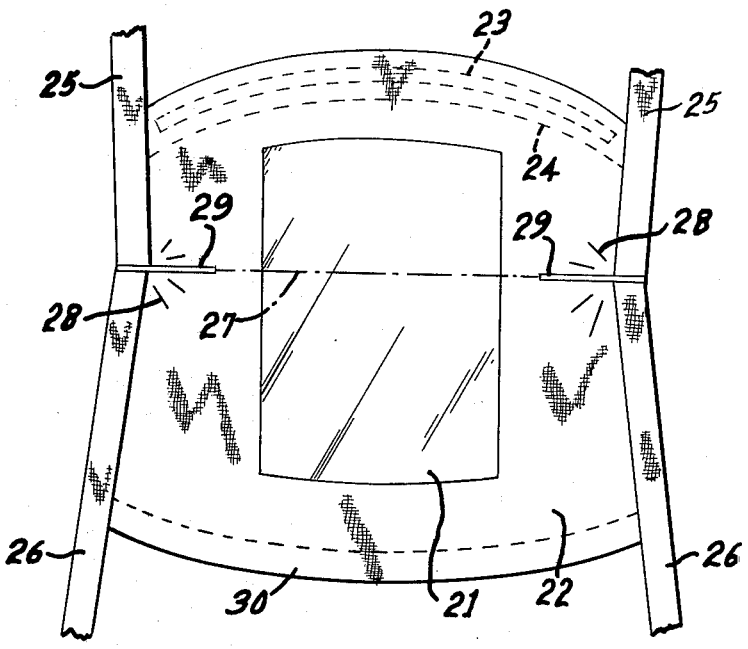
FIG. 4 is a front view of a mask in accord with another embodiment of this invention.
Figure 5:
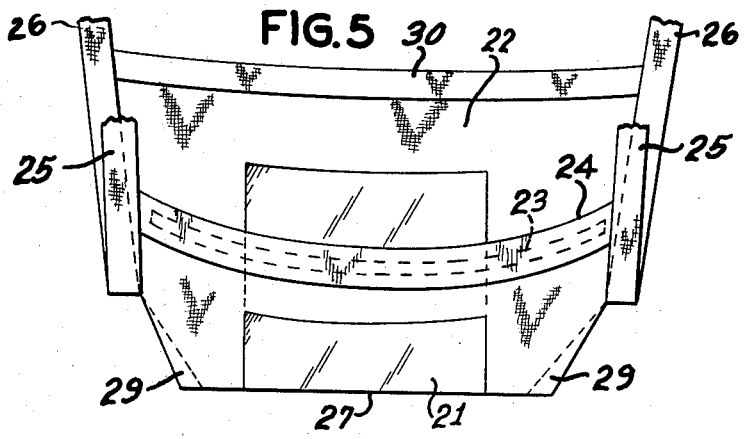
FIG. 5 is a top view of the mask of FIG. 4.
Figure 6:
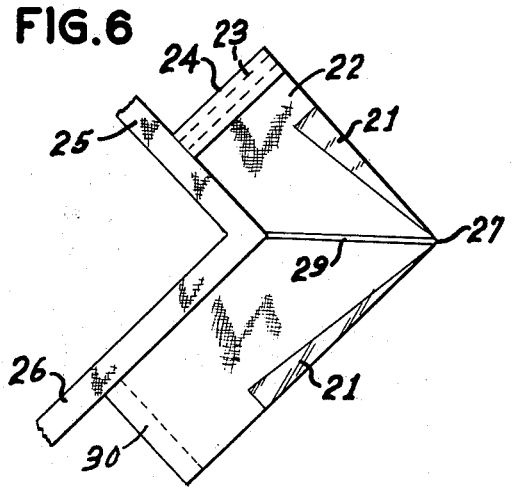
FIG. 6 is a side view of the mask of FIG. 4.

A second type of medical face mask is shown in FIGS. 4,5, and 6. This mask is another type of modern medical mask modified to incorporate the features of this invention. This mask is made of flat fibrous sheet material which has been folded, cemented, and sewed so that it will fit around the nose, mouth, and chin of the wearer without discomfort to the wearer. Central portion 21 of the mask is impermeable to air or moisture and may be opaque or transparent. If it is desired that it be opaque the impermeability can be produced as mentioned previously by coating with lacquer, varnish, cement, or the like. If it is desired that central portion 21 be transparent it may be made of any of a variety of synthetic plastic films mentioned above, the preferred material being "Surlyn" or other ionomer resin.

When central porton 21 is transparent it may be attached to outer portion 22 by cementing, stitching, or the like. Outer portion 22 is air-permeable and is capable of filtering bacteria from the air passing through this portion of the mask.

As described with respect to FIGS. 1 and 2, this mask also has a manually bendable nose clip 23 attached to the top edge of the mask, preferably held in place by tape 24. Two pair of head straps 25 and 26 are employed to tie the mask to the head of the wearer.

The mask is made to protrude from the face of the wearer by folding the material along line 27 and gathering the material of outer portion 22 at ends 28 of line 27. Doubled portions 29 are held in place by cementing together two layers of outer portion 22 to assist in maintaining the protruding cup-shape in the center of the mask. Tape 30 is used along the lower border of outer portion 22 to prevent unraveling of the felted fiber material.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A medical face mask comprising a head strap and mask to fit over the nose, mouth, and chin of the wearer and to conform at its edges reasonably closely to the face and neck of the wearer, the central portion of said mask adjacent the nose and mouth of the wearer being transparent to provide a view therethrough of the mouth of the wearer and being air-impermeable to inhibit air, moisture and bacteria from passing therethrough, and the remaining annular portion surrounding said central portion of said mask being made of air-permeable, bacteria-filtering material to permit breathing by the wearer said annular portion being connected to and along and terminating adjacent to the outer edge portions of said central portion.

2. The mask of claim 1 wherein said transparent material is a plastic preformed into an arcuate configuration.

3. The mask of claim 1 wherein said central portion is a pliable plastic sheet material.

* * * * *